US009016930B2

(12) United States Patent
Cayley, Sr. et al.

(10) Patent No.: US 9,016,930 B2
(45) Date of Patent: Apr. 28, 2015

(54) APPARATUS FOR MOVING LIQUID IN CONTAINER

(75) Inventors: Michael Paul Cayley, Sr., South Barrington, IL (US); Malcolm E. Keith, Algonquin, IL (US)

(73) Assignee: Metal Shapes, Inc., Elk Grove Village, IL (US)

( * ) Notice: Subject to any disclaimer, the term of this patent is extended or adjusted under 35 U.S.C. 154(b) by 1234 days.

(21) Appl. No.: 12/214,816

(22) Filed: Jun. 23, 2008

(65) Prior Publication Data

US 2009/0086573 A1 Apr. 2, 2009

Related U.S. Application Data

(60) Provisional application No. 60/995,755, filed on Sep. 28, 2007.

(51) Int. Cl.
*B01F 11/00* (2006.01)

(52) U.S. Cl.
CPC ..... *B01F 11/0014* (2013.01); *B01F 2215/0072* (2013.01)

(58) Field of Classification Search
CPC ..... B01F 11/0014; A47J 43/42
USPC ..... 366/211, 216, 218
See application file for complete search history.

(56) References Cited

U.S. PATENT DOCUMENTS

| | | | | | |
|---|---|---|---|---|---|
| 2,127,706 | A * | 8/1938 | Talbot | 366/214 |
| 3,777,652 | A * | 12/1973 | Engel | 99/275 |
| 4,673,297 | A * | 6/1987 | Siczek et al. | 366/208 |
| 5,052,812 | A * | 10/1991 | Tannenbaum et al. | 366/209 |
| 5,238,302 | A * | 8/1993 | Rohan | 366/208 |
| 5,593,228 | A * | 1/1997 | Tannenbaum | 366/209 |
| 5,641,229 | A * | 6/1997 | McClintock et al. | 366/208 |
| 6,190,032 | B1 * | 2/2001 | Choda | 366/208 |

* cited by examiner

*Primary Examiner* — Alison Hindenlang
(74) *Attorney, Agent, or Firm* — Pauley Petersen & Erickson

(57) ABSTRACT

An apparatus for swirling wine within a wine glass or a decanter, or for moving a liquid within a container. A driver is mounted to move a driving element with respect to a housing. A base for holding or removably attaching the glass, the decanter or the container, is moveably mounted with respect to the housing. A receiver and a connector are moveably mounted with respect to each other and with respect to the housing. When the driver moves the base, the base and thus the container follow a path defined by movement of the connector with respect to the receiver. When the glass, the decanter or the other container is mounted with respect to the base, the base moves the glass, the decanter or the container to impart a swirling motion of wine or another liquid within the glass, the decanter or the container.

13 Claims, 9 Drawing Sheets

APPARATUS FOR MOVING LIQUID IN CONTAINER

CROSS REFERENCE TO RELATED APPLICATION

This U.S. Patent Application claims the benefit of U.S. Provisional Patent Application having Ser. No. 60/995,755, filed on 28 Sep. 2007. The entire teachings of U.S. Provisional Patent Application having Ser. No. 60/995,755 are incorporated by reference in its entirety and made a part of this U.S. patent application.

BACKGROUND OF THE INVENTION

1. Field of the Invention

This invention relates to an apparatus and method for swirling or otherwise moving one or more liquids within a container, for example wine within a drinking glass and/or a decanter.

2. Discussion of Related Art

Many conventional wine glasses, decanters or other drinking type containers or vessels have been designed to accommodate a swirling motion of wine within the container. Moving a liquid within the container can aerate the liquid or wine and better expose the surface area of the liquid or wine to the atmosphere, which can result in a chemical reaction that enhances the bouquet, taste, flavor and/or aroma of the wine. Moving or swirling wine within a container allows the wine to open-up and enhance the flavor and also the aroma of the wine.

In order to open up or enhance the bouquet of wine, a surface area of the wine is exposed to the atmosphere. Opening a wine bottle and allowing the wine to sit only exposes to the atmosphere a relatively small surface area of the wine positioned within or near a relatively small cross-sectional neck area of the wine bottle. If wine is poured into a decanter or other similar container or vessel and allowed to remain in a static condition, the surface area of the wine exposed to the atmosphere is increased. The aeration or chemical reaction that occurs can be enhanced or accelerated by swirling or otherwise moving the wine within the glass, decanter or other suitable container.

Many wine drinkers use their hands and arms to physically move the glass, decanter or other container, for example to impart a swirling motion of the wine within the container.

There is an apparent need for an automated device or apparatus that can swirl or move wine within a glass or decanter, or that can move another liquid within a container.

SUMMARY OF THE INVENTION

According to this invention, a driver can be mounted with respect to a housing. A plate, base or another suitable structural member can be connected to the driver in a manner which allows the driver to move the plate, the base or the other structural member with respect to the housing. A glass, a decanter or another suitable container can be detachably mounted with respect to the base, so that movement of the driver results in movement of the container.

An apparatus according to this invention can include one or more plates or other structural members that move with respect to each other resulting in or causing the base to move in a pattern or a programmed manner with respect to the housing. These patterned or programmed movements can result in a particular repeating movement of the container and thus a continuous swirling motion of the liquid within the container.

In some embodiments of this invention, the apparatus includes a controller that varies different output parameters of the apparatus, such as a motor speed and/or dimensions of a movement pattern of the base with respect to the housing. The controller can be programmed and used to vary the different parameters, for example, as a function of the particular design of the glass, the decanter and/or the other container.

Different shapes, sizes and dimensions of the glass, the decanter and/or the container may require a different motion to effectively swirl the liquid within the container, for example the wine within the wine glass or the decanter.

Other shapes and dimensions of plate members or other structural members can be varied to accomplish different swirling patterns and/or to accomplish a swirling motion within differently sized or shaped containers.

BRIEF DESCRIPTION OF THE DRAWINGS

Different features of this invention are described in the following specification, particularly when taken in view of the drawings, wherein.

DETAILED DESCRIPTION OF THE INVENTION

Each of FIGS. 1-13 shows different elements of swirling apparatus 30, according to different embodiment of this invention.

Figure 1:
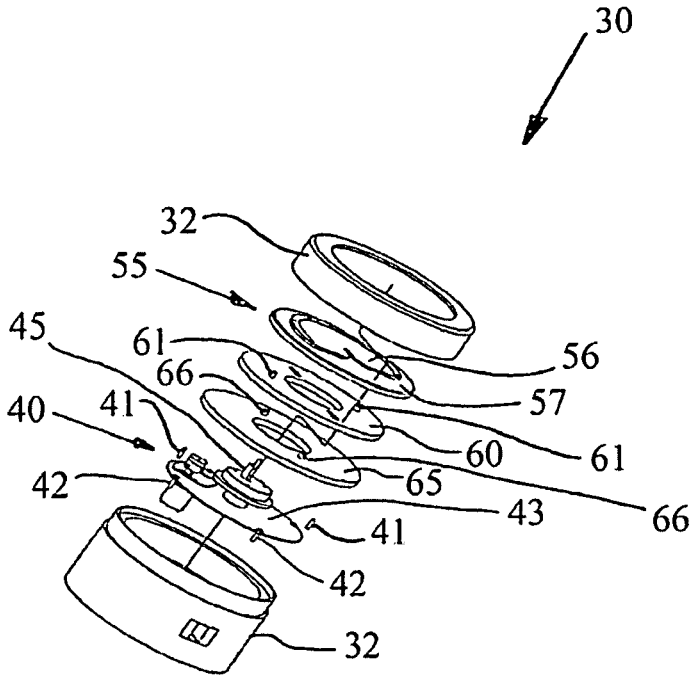
FIG. 1 is a perspective exploded view of a swirling apparatus, according to one embodiment of this invention.
Figure 7:
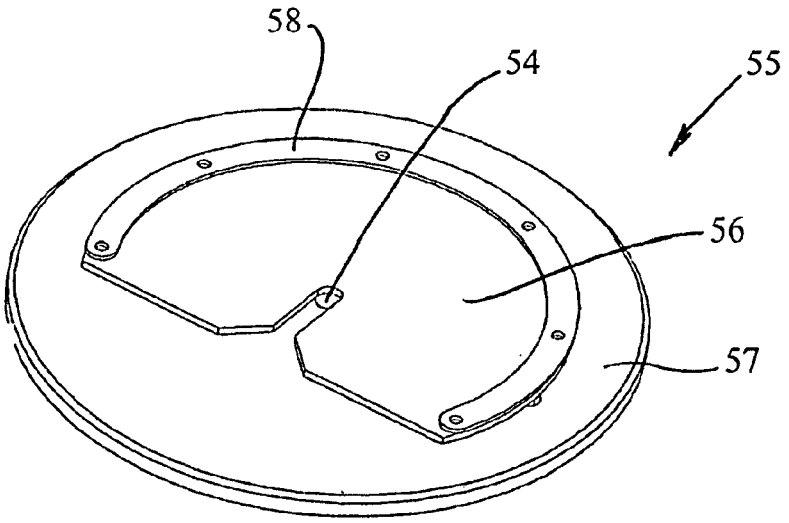
FIG. 7 shows a perspective view of a holder, according to one embodiment of this invention.
Figure 9:
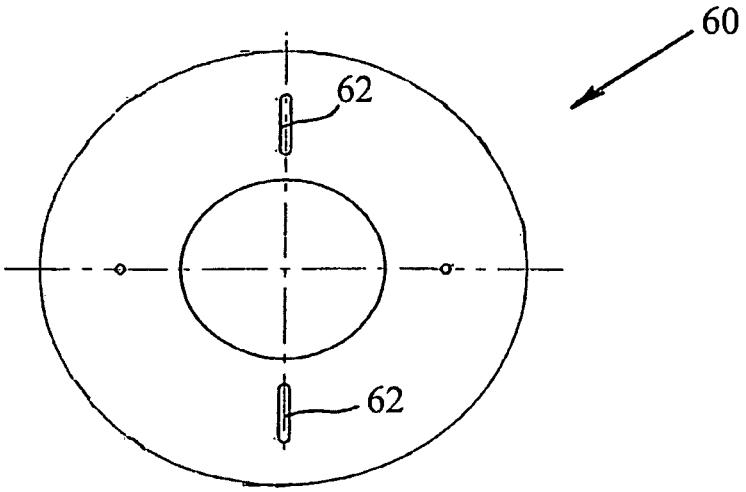
FIG. 9 shows a top view of a receiver, according to one embodiment of this invention.
Figure 10:
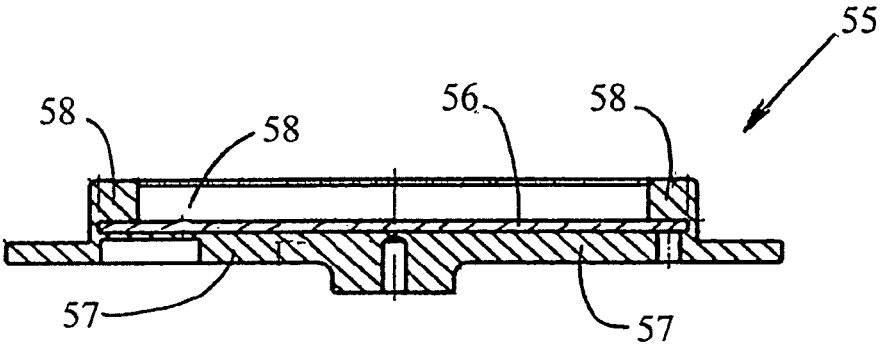
FIG. 10 shows a sectional view taken along a central axis, of a holder, according to one embodiment of this invention.
Figure 11:
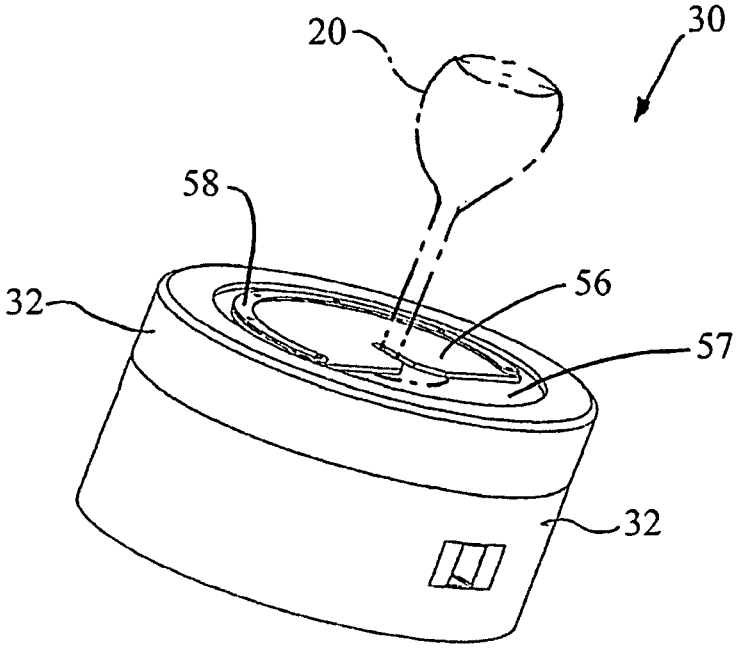
FIG. 11 shows a perspective view of an assembled swirling apparatus, according to another embodiment of this invention.
Figure 13:
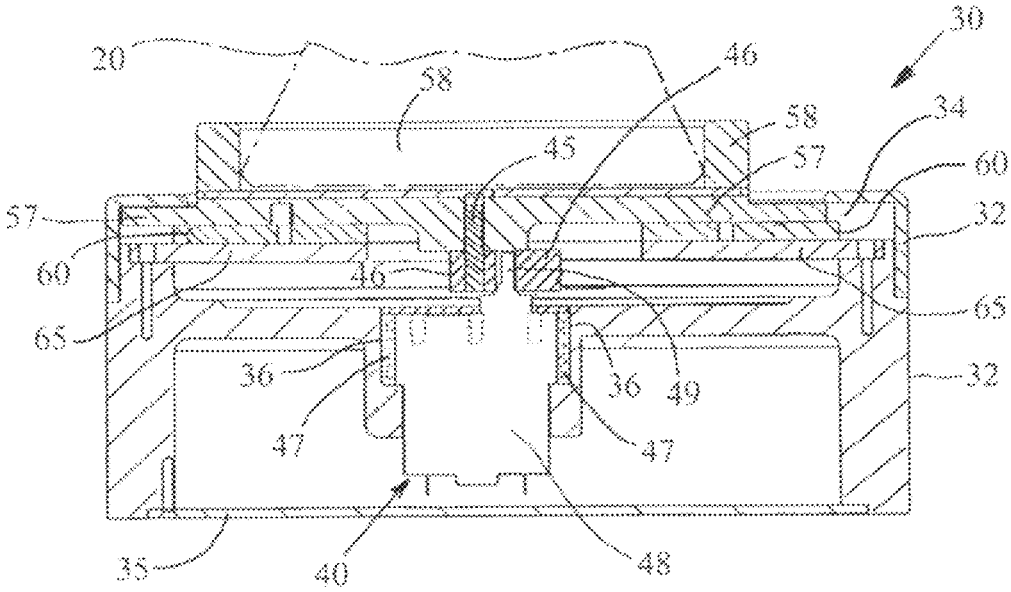
FIG. 13 shows a partial sectional view taken along a central longitudinal axis of an assembled swirling apparatus, according to the embodiment of this invention, as shown in FIG. 12.

Container 20, such as a stem wine glass shown in FIG. 11 and/or a decanter shown in FIG. 13, can be removably positioned within holder 55. For example, base 12 of the wine glass or other container 20 can be slid or positioned between retainer 56 and base 57 of holder 55, such as shown in FIG. 11. Retainer 56 can be a flexible element, for example as shown in FIGS. 1, 7 and 11, or can be any other suitable element, apparatus and/or structure that can mount, secure, connect and/or fix a position of container 20 with respect to base 57. Retainer 56 can be secured or removably attached to or with respect to base 57, such as with bracket 58 shown in FIGS. 7 and 9, or even can be integrated with base 57 such as shown in FIG. 10.

Base 57 can have any suitable shape or size. For example, if container 20 is a decanter, then base 57 may be sized relatively larger than if container 20 is a wine glass. Bracket 58 can have any suitable shape and/or size. For example, as shown in FIGS. 10 and 13, bracket 58 is relatively higher than bracket 58 shown in FIGS. 1, 2 and 7. Depending upon the particular type of container 20, bracket 58 can be shaped and/or sized differently. For example, the relatively higher bracket 58 as shown in FIG. 10 can be used to prevent a decanter 20 from falling off of or away from swirling apparatus 30, particularly when in an operating mode.

Figure 8:
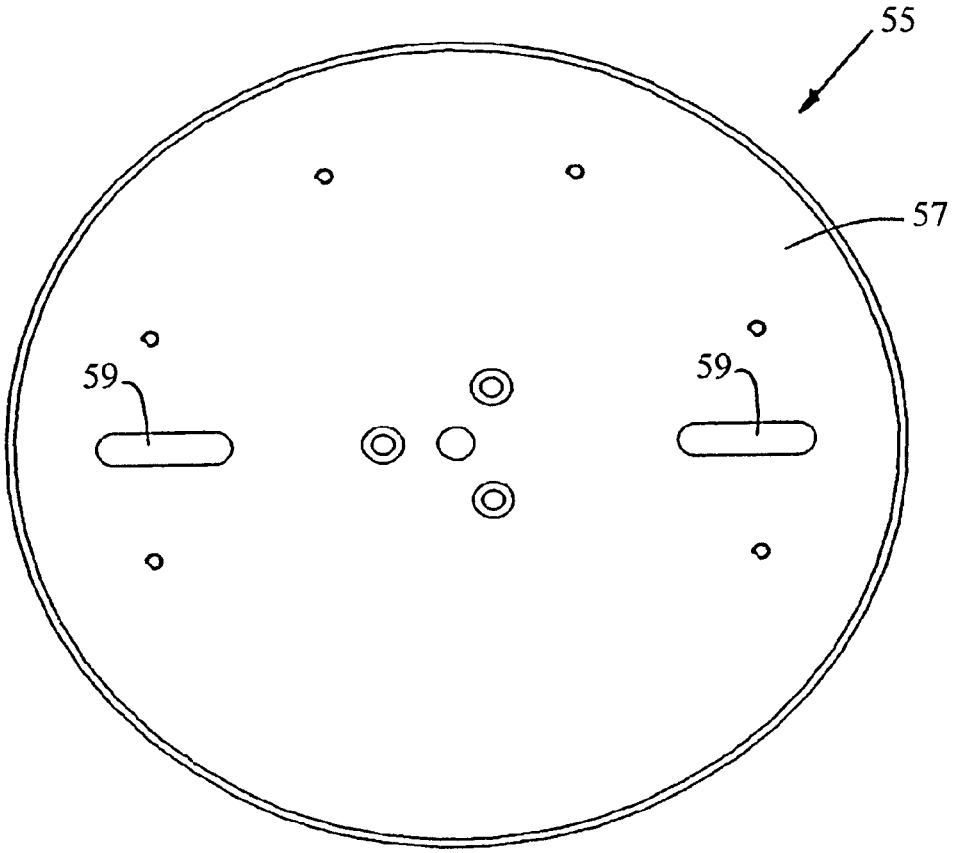
FIG. 8 shows a perspective view of a base of a holder, such as shown in FIG. 7.

As shown in FIGS. 7 and 8, base 57 has or forms at least one void 59. FIG. 8 shows voids 59 oriented in a particular arrangement, and also in the form of a slot. Void 59 can have any other suitable shape and/or size. Each void 59 can be positioned or formed to achieve a desired movement of base 57, for example as a function of the input delivered by driver 40. Bore 54 of base 57, such as shown in FIG. 7, can accommodate or accept shaft or pin 45 of driver 40.

Figure 2:
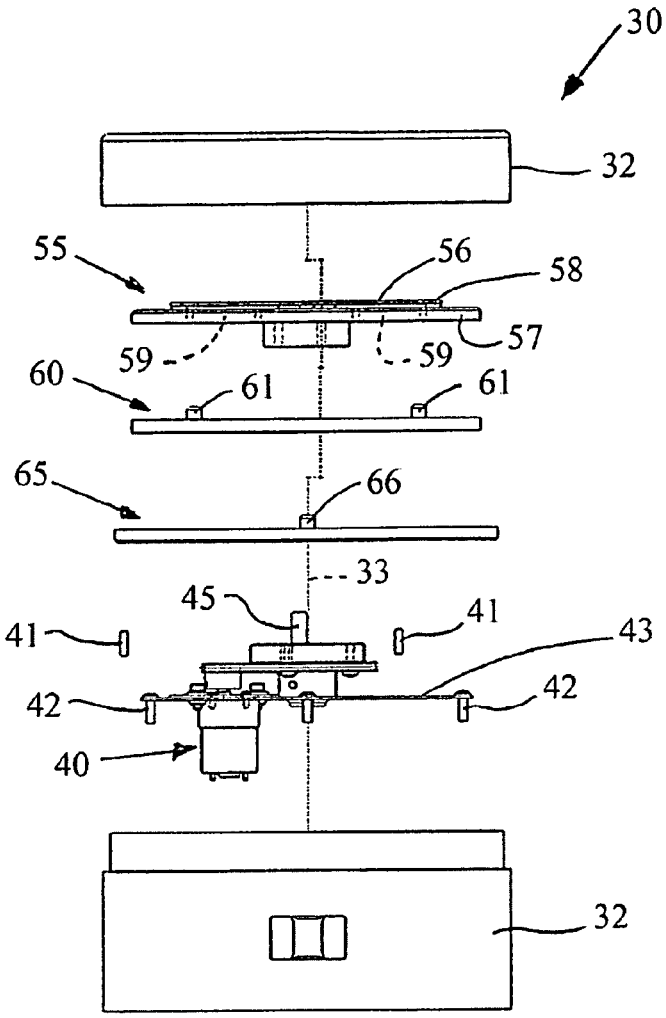
FIG. 2 shows a front exploded view of the swirling apparatus, as shown in FIG. 1.
Figure 3:
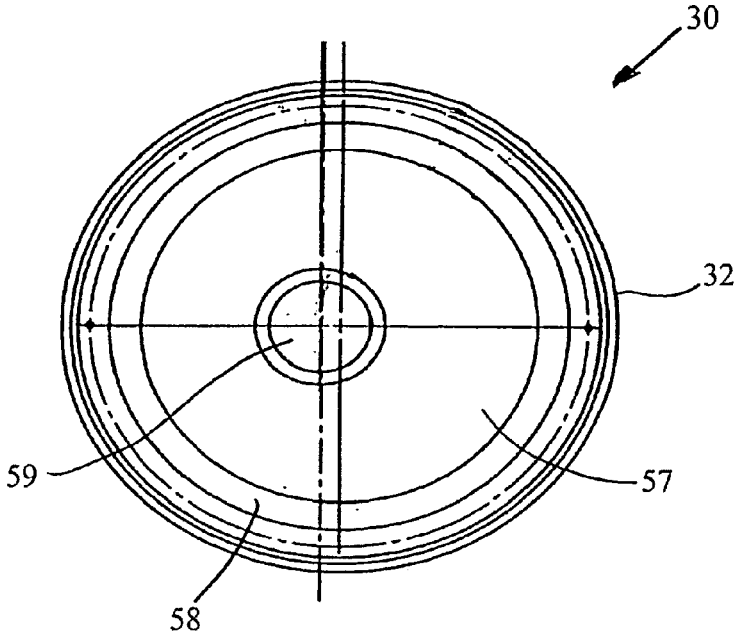
FIG. 3 shows a top view of a swirling apparatus, according to a certain embodiment of this invention.
Figure 4:
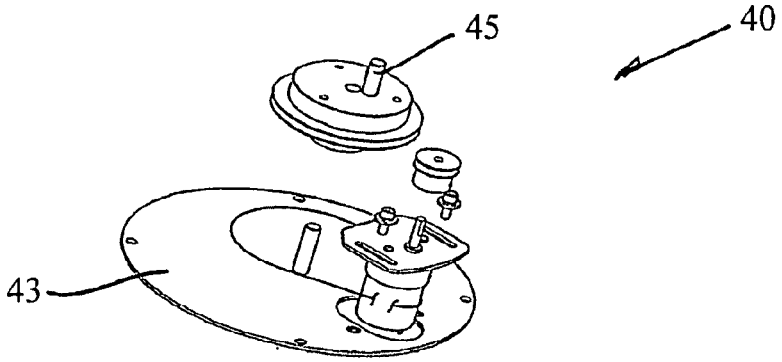
FIG. 4 shows a perspective exploded view of a belt-driven driver, according to one embodiment of this invention.

As shown in FIGS. 1 and 2, receiver 60 is positioned between base 57 and connector 65. In certain embodiments of this invention, base 57, receiver 60 and/or connector 65 are removably attached with respect to one or more of each other.

When in an assembled condition and in an operating mode, receiver 60 and connector 65 move relative to each other to provide a particular motion to base 57 and thus also to container 20. Each particular motion can be designed to impart a swirl within differently shaped and sized containers 20. For example, with base 57 having voids 59 as shown in FIG. 8, base 57 can move in a first direction, such as from left to right as shown in FIG. 2. With receiver 60 having voids 62 as shown in FIG. 9, receiver 60 can move in a second direction, such as into and out of a two-dimensional plane as shown in the drawing of FIG. 2. With pin 45 offset from centerline 33 as shown in FIG. 2, offset rotation of pin 45 about centerline 33 causes pin 61 to move base 57 in the first direction from left to right and causes pin 66 to move receiver 60 in the second direction which is generally perpendicular to the first direction. The overall resulting motion of base 57 with respect to housing 32 can be generally circular or elliptical or can follow any other pattern.

Connector 65 can be positioned between driver 40 and receiver 60, such as shown in FIG. 1. Connector 65 and/or receiver 60 can comprise any relatively flat plate or other suitable structural element that allows connector 65 to move with respect to receiver 60, particularly when apparatus 30 is in an operating mode.

Figure 5:
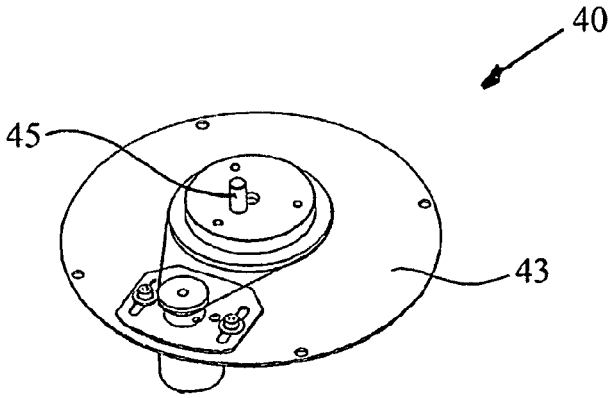
FIG. 5 shows a perspective view of the belt-driven driver, as shown in FIG. 4, but in an assembled condition with respect to a base.
Figure 6:
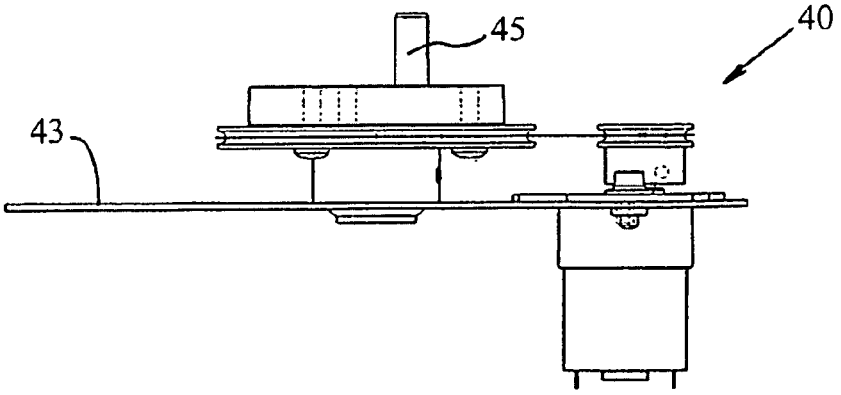
FIG. 6 shows an assembled front view of the belt-driven driver, as shown in FIGS. 4 and 5.

Any suitable driver 40 can be used to move base 57 with respect to housing 32. Driver 40 can be mounted in an offset position with respect to a center line of base 57, such as shown in FIGS. 2 and 5, and indirectly drive base 57. In other embodiments of this invention, driver 40 can be aligned with the center line of base 57, such as shown in FIG. 13, and directly drive base 57. As shown in FIG. 13, driver 40 comprises motor 48 having shaft 49 that rotates with respect to housing 32. Shaft 49 can be positioned within a bore of eccentric 46, such as shown in FIG. 13, or is otherwise connected to eccentric 46. Shaft 49 drives eccentric 46 or another suitable gear or coupling. As shown in FIG. 13, pin 45 is connected to or mounted with respect to eccentric 46 and when eccentric 46 is driven, pin 45 rotates about shaft 49 and as a result connector 60 and base 57 move with respect to each other to move holder 55 in a circular, elliptical and/or orbital movement. Such movement imparts a swirling motion or movement of liquid within container 20.

Any suitable motor or other driving unit can be used as driver 40. Housing 32 can hold or be used to mount any suitable battery or other power unit. Housing 32 can accommodate an outlet for recharging or delivering power to any battery or other power supply.

As shown in FIG. 1, in some embodiments of this invention, pins 61 are used to guide a position of receiver 60 with respect to base 57. For example, base 57 can have slots as voids 59, such as shown in FIG. 8, or another suitably sized and/or shaped opening into which pin 61 can fit. Likewise, pins 66 of connector 65 can be used to moveably attach connector 65 with respect to receiver 60, for example using a pin and slot arrangement. In any pin and slot arrangement described in this specification and in the claims, the roles of the pin or other male connector and the slot or other female connector can be reversed or interchanged.

As shown in FIG. 1, for example, one or more pins 41 or another suitable fastener or connector can be used to fix the position of plate 43 with respect to connector 65. Cover 35, such as shown in FIG. 13, can be removably mounted and/or sealed to protect the interior of housing 32.

Pins 42, as shown in FIG. 1, or any other suitable connector or fastener can be used to attach plate 43 with respect to housing 32. Plate 43 can be attached in any suitable structural manner to form a seal so that any spilled liquid does not penetrate through the exposed elements and into housing 32.

Figure 12:
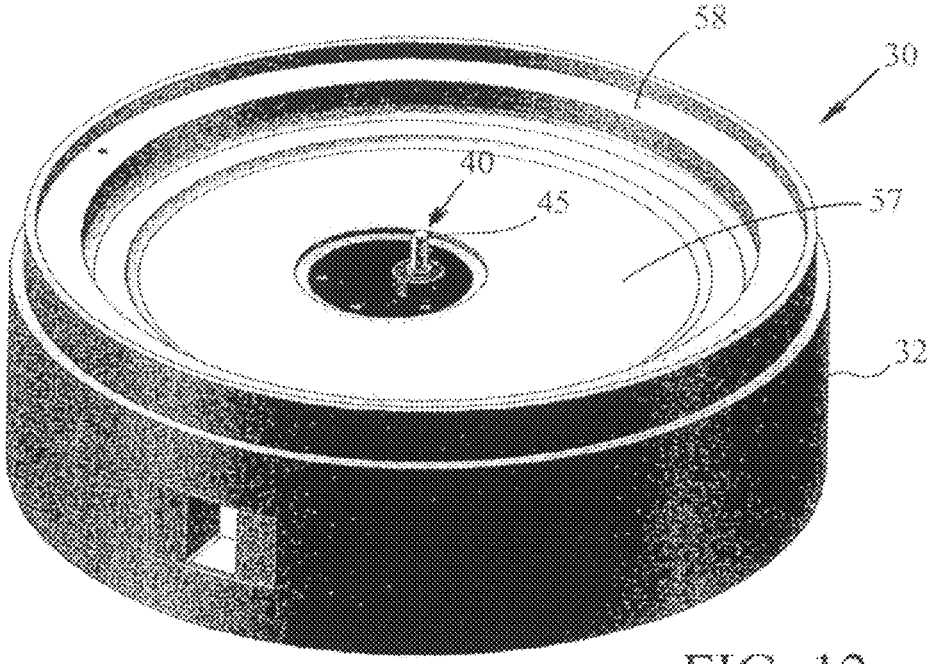
FIG. 12 shows a perspective view of an assembled swirling apparatus, according to another embodiment of this invention.

When assembled, such as shown in FIGS. 12 and 13, rotational movement or any other suitable motion of driver 40 can be used to move pin 45 of driver 40, such as with respect to housing 32. Driver 40 can be a direct drive, an indirect drive and/or can be connected, coupled and/or geared in any suitable mechanical, electromechanical or other movable manner to move base 57 with respect to housing 32 and/or any other element described in this specification and/or in the claims.

As shown in FIG. 13, absorber 47 is positioned between driver 40 and housing 32, for example. Absorber 47 can comprise any suitable liner, gasket, vibration dampener and/or sound dampener or other suitable material which can be mounted or connected with respect to driver 40. In some embodiments of this invention, absorber 47 reduces noise levels of driver 40, such as heard from outside of housing 32. Absorber 47 can be made from any suitable material that provides noise and/or vibration reduction.

By mating pins 61 within corresponding voids 59, slots or other receivers of base 57, and by mating pins 66 within corresponding voids 62, slots or other receivers of receiver 60, any motion of driver 40 can be translated into a circular or non-circular motion of base 57 to thus swirl, for example, wine or another fluid within the glass and/or other suitable container 20 having any one of many differently shaped designs.

In some embodiments of this invention, motor 48 is positioned or mounted within counterbore 36 of housing 32, such as shown in FIG. 13, which can strengthen the structural connection and reduce vibrations and/or noises. Driver 40 and/or motor 48 can be attached or secured with any suitable screw or other connector.

In certain embodiments of this invention, pin 45 engages within a corresponding opening or void within base 57, such as shown in FIG. 13. Depending upon the particular configuration, pin 45 can be offset or centered with respect to an axis of rotation of driver 40. Any suitable belt-driver, gear-driver or other type of motor or other driving unit can be used to rotate a driving element of driver 40.

FIG. 1 shows one connector 65 and one receiver 60. However, it is possible to use more than one connector 65 and/or more than one receiver 60, for example to accomplish a different resulting motion of base 57 with respect to housing 32.

Each of the elements described in this specification can have different shapes and/or sizes. Different elements of this invention can be made with any suitable material, such as metal, plastic and/or any other suitable material and/or composite material.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. An apparatus for moving wine within a wine glass or a wine decanter, the apparatus comprising:

a housing;

a holder adapted to secure the wine glass or the wine decanter to the apparatus, the holder including a base movably mounted at least partially within the housing, the base including a first void longitudinally extending in a first direction;

a driver mounted within the housing, the driver moving the base;

a receiver movably mounted within the housing, the receiver including a first receiver surface and an opposing second receiver surface, a second void in at least the first receiver surface and longitudinally extending in a second direction that is different from the first direction, and a pin extending from the second receiver surface and engaged with the first void to follow a first movement of the base;

a connector mounted within the housing, the connector including a pin engaged with the second void to follow a second movement of the receiver; and a retainer attached to the base on a side of the base that is opposite the receiver, the retainer comprising a flexible member including a groove, and that extends over a foot of the wine glass to secure the wine glass to the base, wherein the foot of the wine glass is slid between the base and the flexible member and a stem of the wine glass is received in the groove.

2. The apparatus according to claim 1, wherein the driver and connector are fixed to a first portion of the housing, and a second portion of the housing extends over the first portion to enclose the base, driver, receiver and connector.

3. The apparatus according to claim 1, further comprising a pin connecting the driver to the base, wherein the pin extends through an opening in each of the receiver and the connector, wherein the pin is offset from, and rotates about, a centerline of the housing, and the opening in each of the receiver and the connector is wider than a rotational path of the pin.

4. The apparatus according to claim 3, wherein the pin is offset from, and rotates about, a shaft of the driver.

5. The apparatus according to claim 3, further comprising an eccentric connecting the pin to the shaft.

6. The apparatus according to claim 5, wherein each of the base and the eccentric include a portion extending through at least one of the opening in each of the receiver and the connector.

7. The apparatus according to claim 1, wherein the retainer comprises a rounded peripheral edge attached to the base by a curved bracket.

8. The apparatus according to claim 7, wherein the retainer comprises a straight peripheral edge section adapted to extend over a portion of the wine glass or the wine decanter.

9. The apparatus according to claim 1, wherein the retainer is formed as one piece with the base.

10. The apparatus according to claim 1, wherein the retainer comprises a bracket encircling a portion of the flexible member.

11. The apparatus according to claim 1, Wherein the flexible member includes a rounded peripheral edge section and a straight peripheral edge section including the groove, and the retainer further comprises: a curved bracket that is curved to correspond to the rounded peripheral edge section, wherein the flexible member is secured between the bracket and the base and covers over half of the foot of the wine glass.

12. The apparatus according to claim 11, further comprising a pin connecting the driver to a center bore of the base, wherein the pin extends through an opening in each of the receiver and the connector, wherein:

the pin is offset from, and rotates about, a centerline of the housing and a shaft of the driver, and the opening in each of the receiver and the connector is wider than a rotational path of the pin; and the groove of the flexible member extends inward from the straight peripheral edge section and over the bore of the base.

13. The apparatus according to claim 12, further comprising an eccentric connecting the pin to the shaft.

* * * * *